US006437260B1

(12) United States Patent
Win-Long

(10) Patent No.: US 6,437,260 B1
(45) Date of Patent: Aug. 20, 2002

(54) HANDLE ASSEMBLY FOR ENABLING ELECTRICAL PRODUCT TO WORK

(75) Inventor: You Win-Long, Taoyuan Shien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/803,003

(22) Filed: Mar. 9, 2001

(30) Foreign Application Priority Data

Oct. 25, 2000 (TW) ..... 089218572

(51) Int. Cl.[7] ..... H01H 27/00

(52) U.S. Cl. ..... 200/43.04; 200/43.09; 200/61.58 R

(58) Field of Search ..... 200/43.01, 43.04, 200/43.05, 43.07, 43.08, 43.09, 61.62, 61.7, 61.71, 61.73, 61.74, 61.76, 61.81, 61.82, 61.58 R

(56) References Cited

U.S. PATENT DOCUMENTS 3,863,045 A * 1/1975 Rosenberry ..... 200/61.82
3,924,085 A * 12/1975 Stone ..... 200/61.62
4,321,445 A * 3/1982 Kristof et al. ..... 126/197
4,529,852 A * 7/1985 Lewandowski ..... 200/1 B
4,688,023 A * 8/1987 McGill et al. ..... 200/61.74
4,764,648 A * 8/1988 Resh ..... 200/50.1

* cited by examiner

*Primary Examiner*—Michael Friedhofer
(74) *Attorney, Agent, or Firm*—Niro, Scavone, Haller & Niro

(57) ABSTRACT

A handle assembly for enabling an electrical product to work is provided. The electrical product has an activating device for activating the electrical product including a handle moveably connected with the electrical product, a driving element thereon for enabling the electrical product to work when the driving element is in touch with said the activating device of the electrical product, and a locking device for securing said the handle to the electrical product when the driving element is in touch with the activating device of the electrical product.

14 Claims, 4 Drawing Sheets

HANDLE ASSEMBLY FOR ENABLING ELECTRICAL PRODUCT TO WORK

FILED OF THE INVENTION

The present invention relates to a handle assembly for an electrical product to activate electrical power. More specially, the present invention provides a handle assembly to be locked into a locking device to enable the electrical product to work.

BACKGROUND OF THE INVENTION

FIG. 1 shows a conventional structure of a handle assembly. As can be seen in FIG. 1, a protrusion 11 is set on a handle 12 to be inserted into a hole 13 disposed in a power supply or an electrical product. Then, the power supply or the electrical product will be activated by inserting the protrusion 11 into the hole 13 to supply an electrical source. In the conventional handle, the connection between the protrusion 11 and the hole 32 will be easily disconnected or loosely connected due to careless touching of the handle 12. Thus, the goods produced in the manufacturing line will suffer great damages from a sudden power failure.

Therefore, it is an attempt by the applicant to provide a handle assembly to solve the problems as described above.

SUMMARY OF THE INVENTION

It is therefore an object of the present invention to provide a handle assembly for enabling an electrical product to work.

It is therefore another object of the present invention to provide a handle assembly including a locking device thereon to be tightly connected to stabilize the power supply.

According to the present invention, the handle assembly is provided to enable an electrical product to work. The electrical product has an activating device for activating the electrical product. And the handle assembly includes a handle and a locking device. The handle is moveably connected with the electrical product and has a driving element thereon for enabling the electrical product to work when the driving element is in touch with the activating device of the electrical product. The locking device is used for securing said the handle to the electrical product when the driving element is in touch with the activating device of the electrical product.

Preferably, the handle is pivotally connected with said electrical product. The activating device is a switch disposed in a first recess of the electrical product and the driving element of the handle is a first protrusion for enabling the electrical product to work when the first protrusion of the handle is in touch with the switch of the electrical product.

Preferably, the locking device includes a locking plate moveably disposed on the electrical product, a first engaging element, and a second engaging element disposed on the handle for engaging with the first engaging element of the locking plate when the first protrusion of the handle is in touch with the switch of the electrical product, thereby securing the handle to the electrical product.

Preferably, the first engaging element is a second protrusion and the second engaging element is a second recess.

It is another object of the present invention to provide an electrical product assembly. According to the present invention, the electrical product assembly includes an electrical product having an activating device thereon for activating the electrical product, a handle moveably connected with the electrical product and having a driving element thereon for enabling the electrical product to work when the driving element is in touch with the activating device of the electrical product, and a locking device for securing the handle to the electrical product when the driving element is in touch with the activating device of the electrical product.

It is a further object of the present invention to provide an electrical product assembly. According to the present invention, the electrical product assembly including an electrical product having an activating device thereon for activating the electrical product, a handle pivotally connected with the electrical product and having a driving element thereon for enabling the electrical product to work when the driving element is in touch with the activating device of the electrical product, and a locking device for securing the driving element of the handle to the activating device of the electrical product.

A better understanding of the present invention can be obtained when the following detailed description of a preferred embodiment is considered in conjunction with the following drawings, in which:

DETAILED DESCRIPTION OF THE EMBODIMENTS

Figure 1:
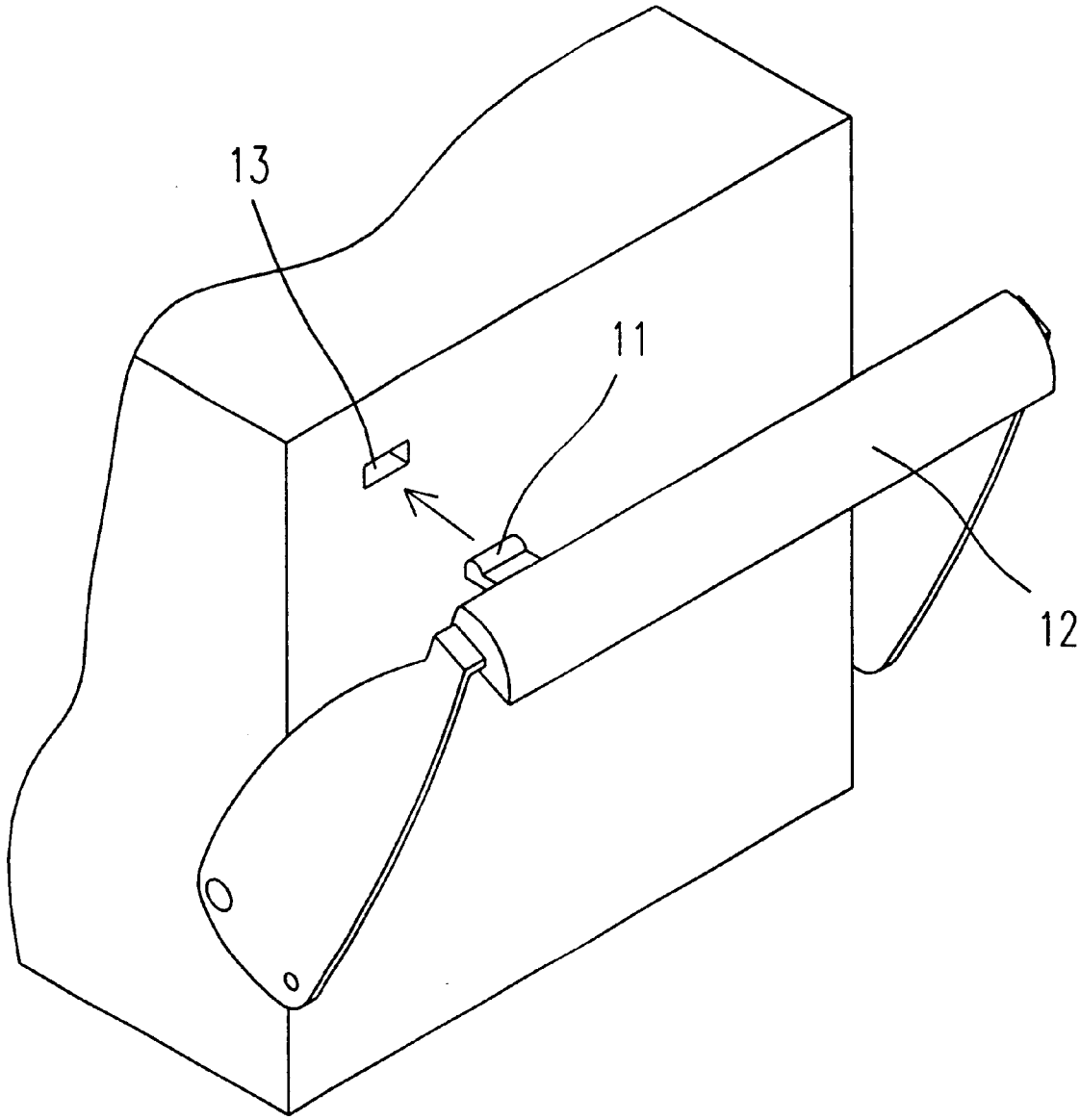
Fig. 1(PRIOR ART)
FIG. 1 is a conventional structure of a handle assembly.
Figure 2:
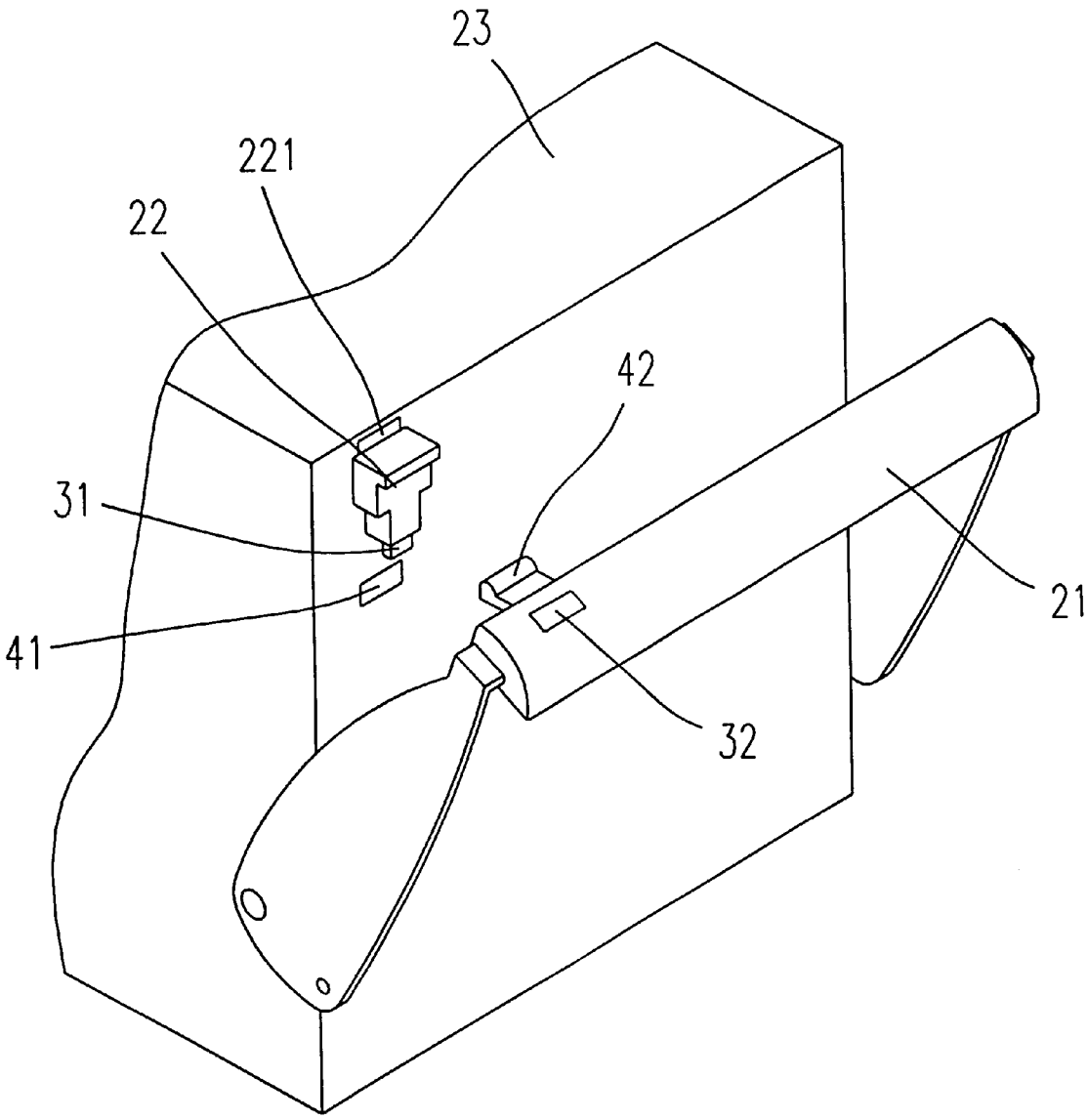
FIG. 2 is a schematic view of a handle assembly according to the preferred embodiment of the present invention, wherein the handle is disconnected from the electrical product.

Referring to FIG. 2, the handle is disconnected from the electrical product 23. The handle assembly includes a handle 21, a locking device 22, and an electrical product 23. The electrical product 21 can be a power supply for providing an electrical power source.

The electrical product 23 has an activating device, e. g. a switch (not shown) disposed in a first recess 41 of the electrical product 23 for activating the electrical product 22 to provide an electrical resource.

The handle 21 moveably connected with the electrical product 22 further has a driving element, for example a first protrusion 42 thereon for enabling the electrical product 23 to work when the driving element is in touch with the activating device of the electrical product 23. The locking device 22 is used for securing the handle 21 to the electrical product 23 when the driving element 42 is in touch with the activating device of the electrical product.

Figure 3:
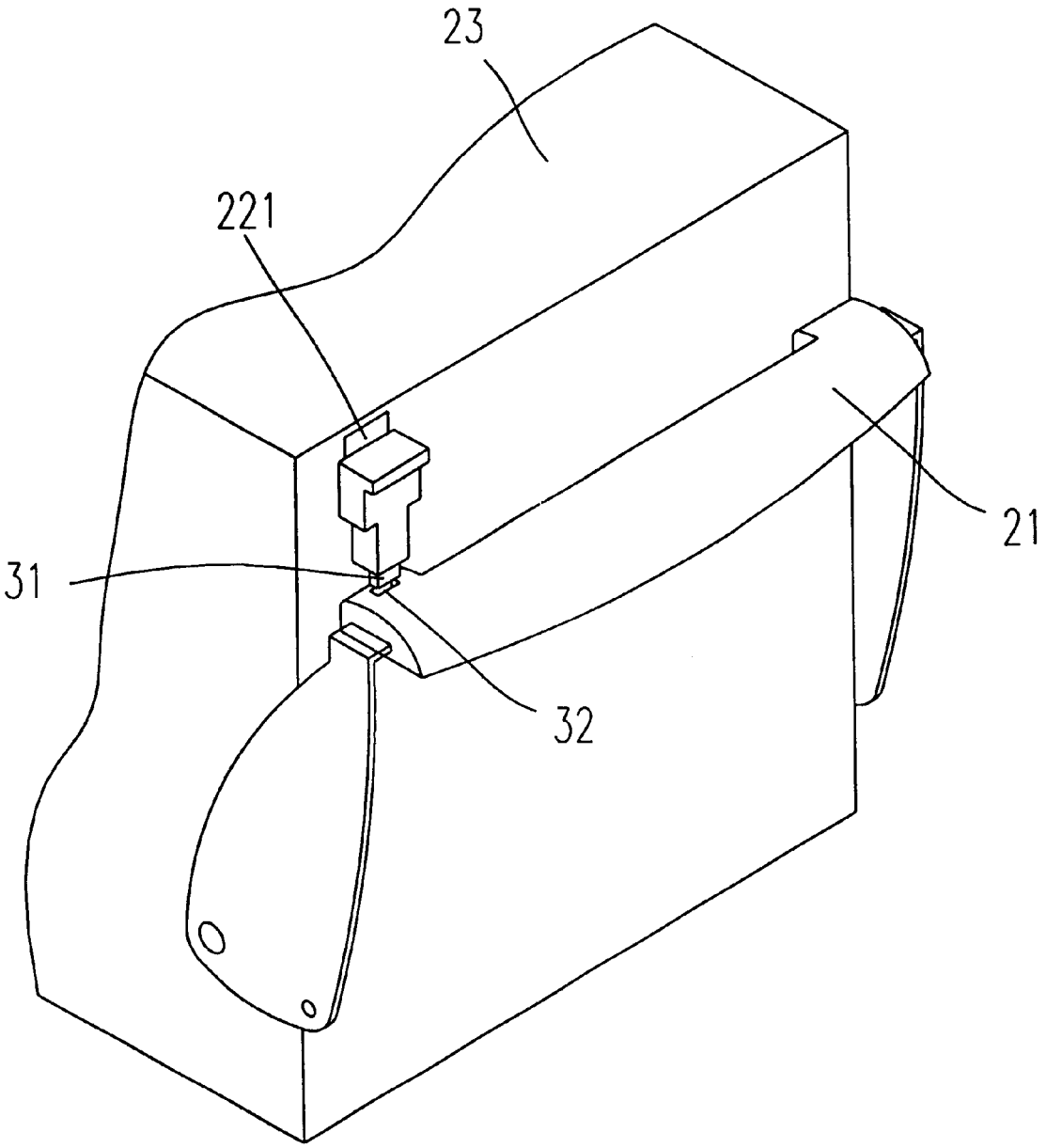
FIG. 3 is a schematic view of the handle assembly shown in FIG. 2, wherein the handle is initially connected with the locking device.

FIG. 3 is a schematic view of the handle assembly shown in FIG. 2, wherein the handle is initially connected with the locking device. The locking device 22 includes a locking plate 221 moveably disposed on the electrical product, a first engaging element, e. g. a second protrusion 31 disposed at the locking device 22, and a second engaging element, e. g. a second recess 32 disposed on the handle 21 for engaging with the first engaging element of the locking plate 221 when the second recess 32 of the handle is in touch with the switch of the electrical product 23, thereby securing the handle 21 to the electrical product 23.

Figure 4:
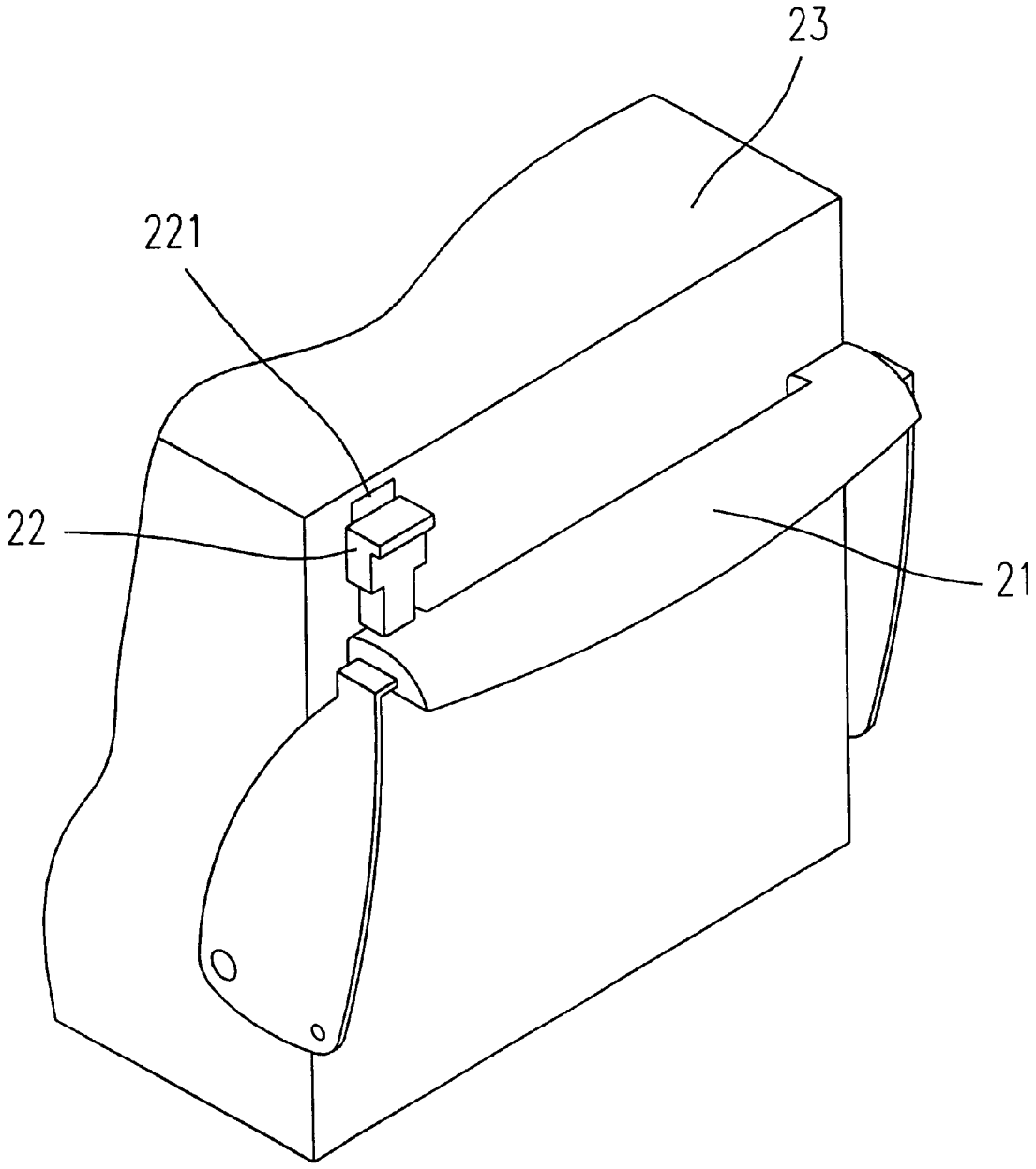
FIG. 4 is a schematic view of the handle assembly illustrating the handle is completely connected with the electrical product.

FIG. 4 is a schematic view of the handle assembly, wherein the handle is completely connected with the electrical product. The activating device is disposed in a first recess 41 of the electrical product 23 and the driving element of the handle is a first protrusion 42 for enabling the electrical product 23 to work when the first protrusion 42 of the handle 21 is in touch with the switch of the electrical product.

Therefore, the present invention provides two mechanisms for securing the handle 21 to the electrical product 23. When the handle 21 is initially connected to the locking device 22, the connection of the first recess 32 and the first protrusion 31 is the first mechanism shown on FIG. 3 for preventing the handle 21 from disconnecting with the electrical product 23. Next, the connection of the second protrusion 32 and the second recess 11 is the second mechanism shown in FIG. 4 for avoiding disconnecting due to careless touching of the handle assembly.

Certainly, the first protrusion 31 and the first recess 41, the second protrusion 42 and the second recess 32 can be designed by different shapes for engagement respectively. In addition, the handle assembly can be disposed at any position on the electrical product as user's wishes and the demands of manufacturing assembly line, for example setting the locking device inside the electrical product.

Accordingly, the handle assembly of the present invention thoroughly overcomes the drawbacks in the prior art, and bear advantage of being widely applied in different electrical products, avoiding the easily disconnected problem and greatly increasing the stability by adding a locking device for securing the handle assembly to the electrical product.

While the invention has been described in terms of what are presently considered to be the most practical and preferred embodiments, it is to be understood that the invention needs not be limited to the disclose embodiments. On the contrary, it is tented to cover various modification and similar arrangements included within the spirit and scope of the appended claims which are be accorded with the broadest interpretation so as to encompass all such modifications and similar structure.

What is claimed is:

1. A handle assembly for enabling a power supply to work, wherein said power supply has an activating device for activating said power supply, comprising:

a handle moveably connected with said power supply for assisting to move said power supply and having a driving element thereon for enabling said power supply to work when said driving element is in touch with said activating device of said power supply; and a locking device for securing said handle to said power supply when said driving element is in touch with said activating device of said power supply.

2. The handle assembly according to claim 1, wherein said handle is pivotally connected with said power supply.

3. The handle assembly according to claim 1, wherein said activating device is a switch disposed in a first recess of said power supply and said driving element of said handle is a first protrusion for enabling said power supply to work when said first protrusion of said handle is in touch with said switch of said power supply.

4. The handle assembly according to claim 3, wherein said locking device comprises:

a locking plate moveably disposed on said power supply and having an first engaging element; and a second engaging element disposed on said handle for engaging with said first engaging element of said locking plate when said first protrusion of said handle is in touch with said switch of said power supply, thereby securing said handle to said power supply.

5. The handle assembly according to claim 4, wherein said first engaging element is a second protrusion and said second engaging element is a second recess.

6. A power supply assembly, comprising:

a power supply having an activating device thereon for activating said power supply;

a handle moveably connected with said power supply for assisting to move said power supply and having a driving element thereon for enabling said power supply to work when said driving element is in touch with said activating device of said power supply; and a locking device for securing said handle to said power supply when said driving element is in touch with said activating device of said power supply.

7. The power supply assembly according to claim 6, wherein said handle is pivotally connected with said power supply.

8. The power supply assembly according to claim 6, wherein said activating device is a switch disposed in a first recess of said power supply and said driving element of said handle is a first protrusion for enabling said power supply to work when said first protrusion of said handle is in touch with said switch of said power supply.

9. The power supply assembly according to claim 8, wherein said locking device comprises:

a locking plate moveably disposed on said power supply and having an first engaging element; and a second engaging element disposed on said handle for engaging with said first engaging element of said locking plate when said protrusion of said handle is in touch with said switch of said power supply, thereby securing said handle to said power supply.

10. The power supply assembly according to claim 9, wherein said first engaging element is a second protrusion and said second engaging element is a second recess.

11. A power supply assembly, comprising:

a power supply having an activating device thereon for activating said power supply;

a handle pivotally connected with said power supply for assisting to move said power supply and having a driving element thereon for enabling said power supply to work when said driving element is in touch with said activating device of said power supply; and a locking device for securing said driving element of said handle to said activating device of said power supply.

12. The power supply assembly according to claim 11, wherein said activating device is a switch disposed in a first recess of said power supply and said driving element of said handle is a first protrusion for enabling said power supply to work when said protrusion of said handle is in touch with said switch of said power supply.

13. The power supply assembly according to claim 12, wherein said locking device comprises:

a locking plate moveably disposed on said power supply and having an first engaging element; and a second engaging element disposed on said handle for engaging with said first engaging element of said locking plate when said protrusion of said handle is in touch with said switch of said power supply, thereby securing said handle to said power supply.

14. The power supply assembly according to claim 13, wherein said first engaging element is a second protrusion and said second engaging element is a second recess.

* * * * *